US006273753B1

(12) United States Patent
Ko

(10) Patent No.: US 6,273,753 B1
(45) Date of Patent: Aug. 14, 2001

(54) TWINAX COAXIAL FLAT CABLE CONNECTOR ASSEMBLY

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/693,269

(22) Filed: Oct. 19, 2000

(51) Int. Cl.[7] ..... H01R 9/05
(52) U.S. Cl. ..... 439/579; 439/497; 439/607
(58) Field of Search ..... 439/579, 497, 439/610, 607

(56) References Cited

U.S. PATENT DOCUMENTS

| | | | | |
|---|---|---|---|---|
| 3,663,922 | * | 5/1972 | Foust, Jr. et al. | 439/497 |
| 4,365,856 | * | 12/1982 | Yaegashi et al. | 439/497 |
| 4,993,968 | * | 2/1991 | Guletsky et al. | 439/492 |
| 5,030,138 | * | 7/1991 | Capp et al. | 439/497 |
| 5,057,038 | * | 10/1991 | Bowen et al. | 439/497 |
| 5,085,595 | * | 2/1992 | Koegel et al. | 439/494 |
| 5,387,124 | * | 2/1995 | Shinohara et al. | 439/497 |
| 5,980,308 | * | 11/1999 | Hu et al. | 439/497 |
| 6,077,115 | * | 6/2000 | Yang et al. | 439/597 |
| 6,123,582 | * | 9/2000 | Ko et al. | 439/579 |
| 6,139,363 | * | 10/2000 | Ko et al. | 439/579 |
| 6,183,281 | * | 2/2001 | Wu et al. | 439/260 |

* cited by examiner

*Primary Examiner*—Brian Sircus
*Assistant Examiner*—Hae Moon Hyeon
(74) *Attorney, Agent, or Firm*—Wei Te Chung

(57) ABSTRACT

A twinax coaxial flat cable connector assembly (1) includes a plurality of twinax coaxial wires (10), an insulative insert (20), a plurality of terminals (30), a housing (40), a grounding bar (309), and an EMI shield (50). Each twinax coaxial cable includes a pair of coaxial conductors (103), an insulating layer (104) isolating the pair of conductors from each other, a metal braid layer (105) enclosing the insulating layer, and a cable jacket (106) enclosing the metal braid layer. The elongate insulative insert defines a plurality of channels (202), a plurality of slots (204) each with a pair of projections (206) and a groove (205), and an elongate slot (201) connecting the channels with the slots. In assembly, the channels position the jackets of the twinax coaxial cables, each groove secures a rear portion of a corresponding terminal, each coaxial conductor is secured between a corresponding pair of projections and electrically connects with a corresponding terminal, and the grounding bar is inserted into the elongate slot to electrically connect to the metal braid layer of all the twinax coaxial wires. The shield is assembled to the outside of the housing and the insert is assembled into the housing such that the shield electrically contacts the grounding bar in the insert. Thus the improved insert securely positions and holds the coaxial conductor and the shielding effect is improved.

8 Claims, 9 Drawing Sheets

TWINAX COAXIAL FLAT CABLE CONNECTOR ASSEMBLY

FIELD OF THE INVENTION

The present invention relates to a cable connector assembly, and particularly to a twinax coaxial flat cable connector assembly for use with a digital panel or LCD (Liquid Crystal Display).

BACKGROUND OF THE INVENTION

A conventional flat cable connector assembly is used for connecting two electrical devices separated from each other a relative long distance. The assembly has a flat flexible cable having a plurality of conductors therein for transmitting signal. The conductors are connected with respective terminals of connectors of the assembly. As transmitting speed is increased between the electrical devices, a flat coaxial cable is used for transmitting high speed signal. The flat coaxial cable comprises a plurality of parallel and equally spaced signal transmission lines, each line being constructed by a micro coaxial cable consisting of a central conductor, a layer of insulation surrounding the conductor, a metal braid surrounding the insulation and a jacket surrounding the metal braid as disclosed in U.S. Pat. No. 6,123,582 and the copending application Ser. No. 09/350,942 filed Jul. 9, 1999. Although such design can avoid cross talk between neighboring two lines, it still has a relatively large electrical skew, failing to meet the electrical performance requirements. Hence, an improved coaxial flat cable connector assembly is required to overcome the disadvantages of the presently used flat cable connector assemblies.

BRIEF SUMMARY OF THE INVENTION

A first object of the present invention is to provide a coaxial flat cable connector assembly which can minimize electrical skew of the assembly to meet the electrical performance requirements.

A second object of the present invention is to provide a twinax coaxial flat cable connector assembly having an improved insulative insert for positioning and holding the twinax coaxial conductors to meet functional requirements.

A third object of the present invention is to provide a twinax coaxial flat cable connector assembly having an improved shielding effect.

A twinax coaxial flat cable connector assembly in accordance with the present invention comprises a plurality of twinax coaxial wires, an insulative insert, a plurality of terminals, a housing, a grounding bar, and an EMI shield. Each twinax coaxial cable includes a pair of coaxial conductors, an insulating layer isolating the pair of conductors from each other, a metal braid layer enclosing the insulating layer, and a cable jacket enclosing the metal braid layer. The elongate insulative insert defines a plurality of channels, a plurality of slots each with a pair of projections and a groove, and an elongate slot connecting the channels with the slots. In assembly, the channels position the jackets of the twinax coaxial cables, each groove secures a rear portion of a corresponding terminal, each coaxial conductor is secured between a corresponding pair of projections and electrically connects with a corresponding terminal, and the grounding bar is inserted into the elongate slot to electrically connect to the metal braid layer of all the twinax coaxial wires. The shield is assembled to the outside of the housing and the insert is assembled into the housing such that the shield electrically contacts the grounding bar in the insert.

Thus the improved insert securely positions and holds the coaxial conductors and the shielding effect is improved.

Other objects, advantages and novel features of the invention will become more apparent from the following detailed description of the present embodiment when taken in conjunction with the accompanying drawings.

DETAILED DESCRIPTION OF THE INVENTION

Figure 1:
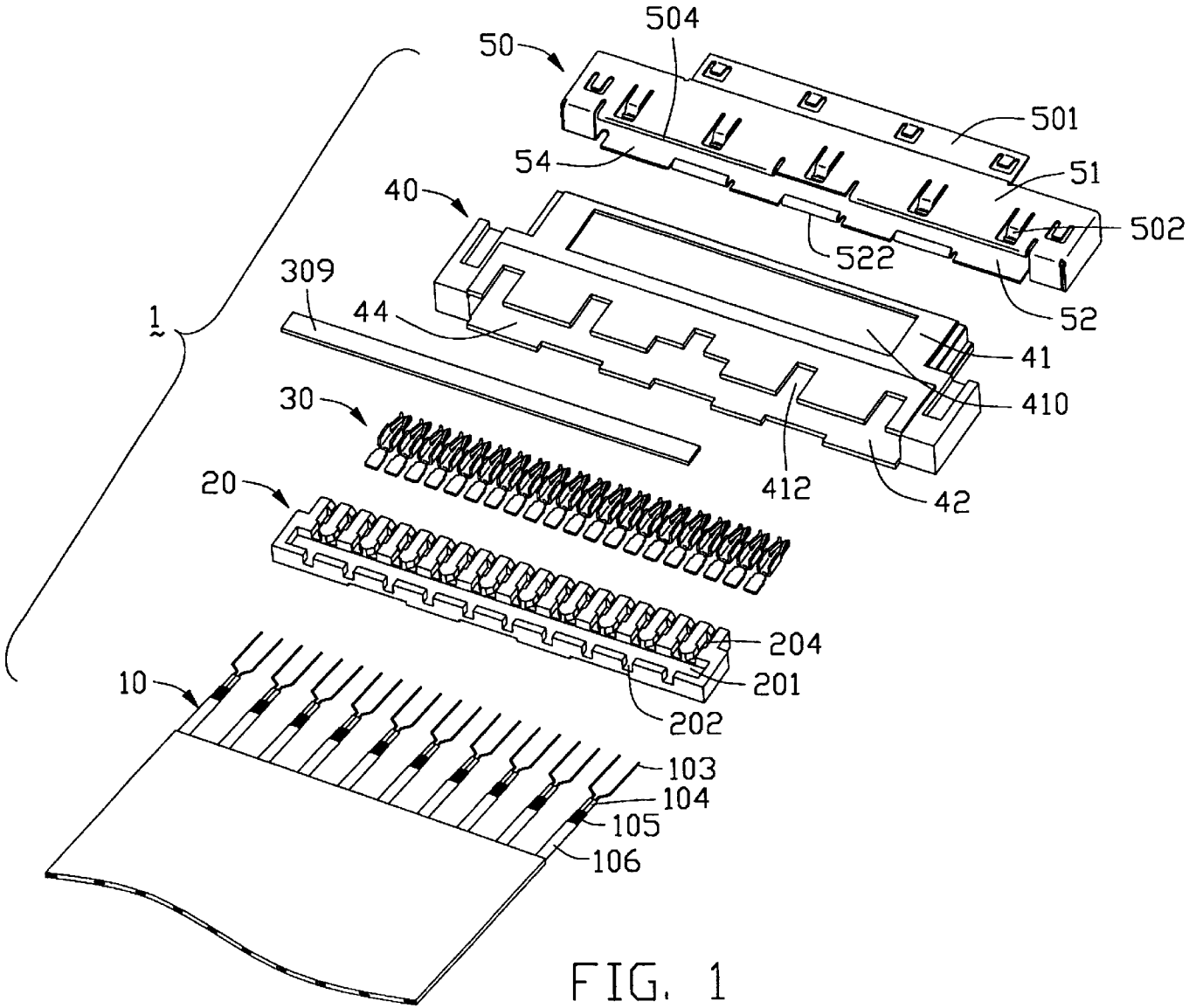
FIG. 1 is an exploded view of a twinax coaxial flat cable connector assembly in accordance with the present invention.

Referring to FIG. 1, a twinax coaxial flat cable connector assembly 1 in accordance with the present invention comprises a plurality of twinax coaxial wires 10, an insulative insert 20, a plurality of terminals 30, a housing 40, and an EMI shield 50.

Figure 2:
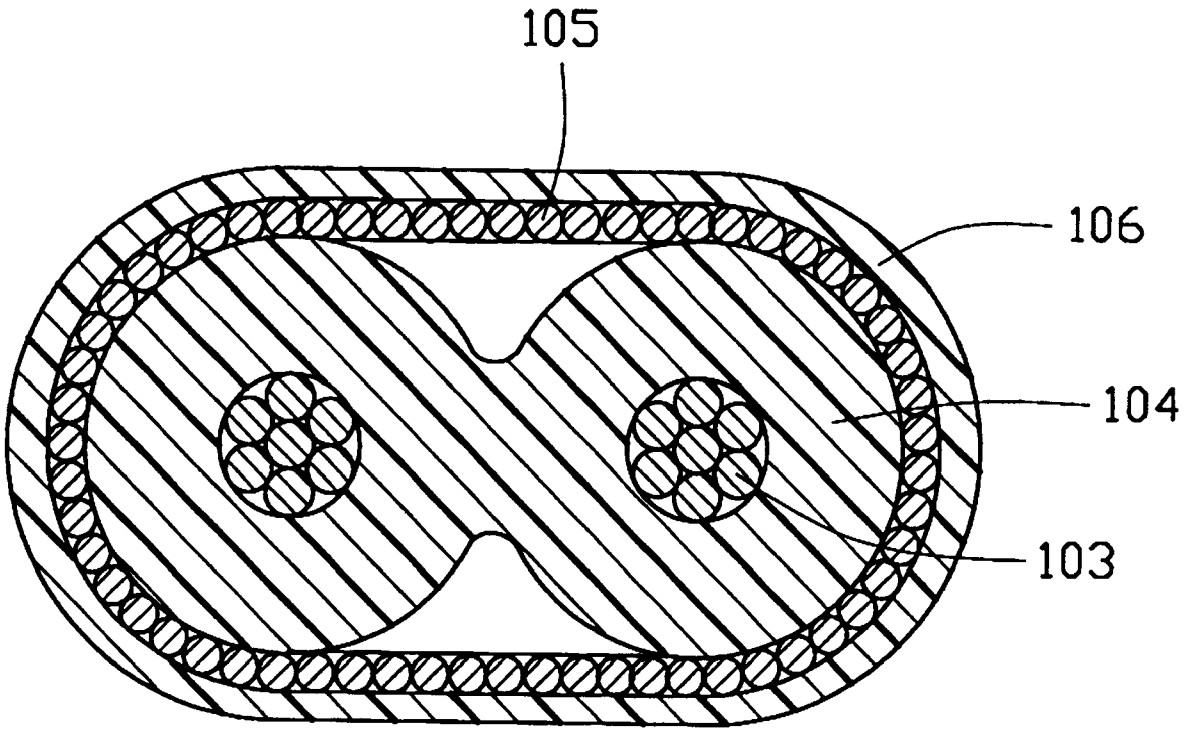
FIG. 2 is a cross sectional view of a twinax coaxial wire.

Referring to FIG. 2, each twinax coaxial wire 10 comprises a pair of coaxial conductors 103 separated a fixed distance apart, an insulating layer 104 wrapping the pair of coaxial conductors 103, a metal braid layer 105 enclosing the insulating layer 104, and a cable jacket 106 enclosing the metal braid layer 105. Both coaxial conductors 103 are electrically isolated from each other. As shown in FIG. 1, the metal braid layer 105 is exposed at a front end of the cable jacket 106, and a front end of each coaxial conductor 103 extends out beyond the metal braid layer 105.

Figure 3:
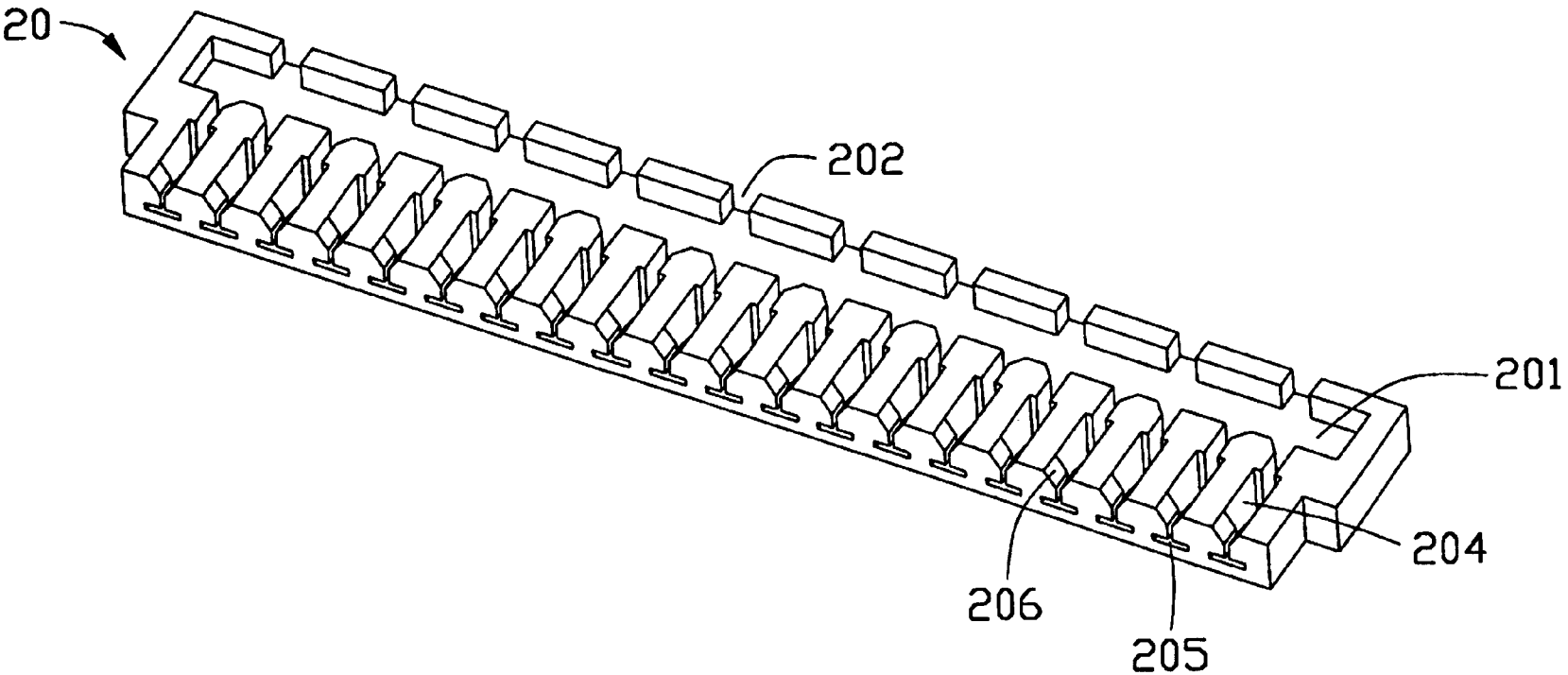
FIG. 3 is a perspective view of an insulative insert viewed from a front aspect.

Referring to FIGS. 1 and 3, the insulative insert 20 extends elongately and defines an elongate slot 201, a plurality of channels 202 at a rear end of the elongate slot 201 for holding the jackets 106 of the twinax coaxial wires 10, two slots 204 paired with each channel 202, the slots 204 and channels 202 commonly communicating with the elongate slot 201, and a plurality of grooves 205 defined in a front end of the insert 20, each groove 205 communicating with a corresponding slot 204. A pair of projections 206 is formed at a front of and on opposite sides of each slot 204 for positioning the coaxial conductor 103 therebetween.

Figure 4:
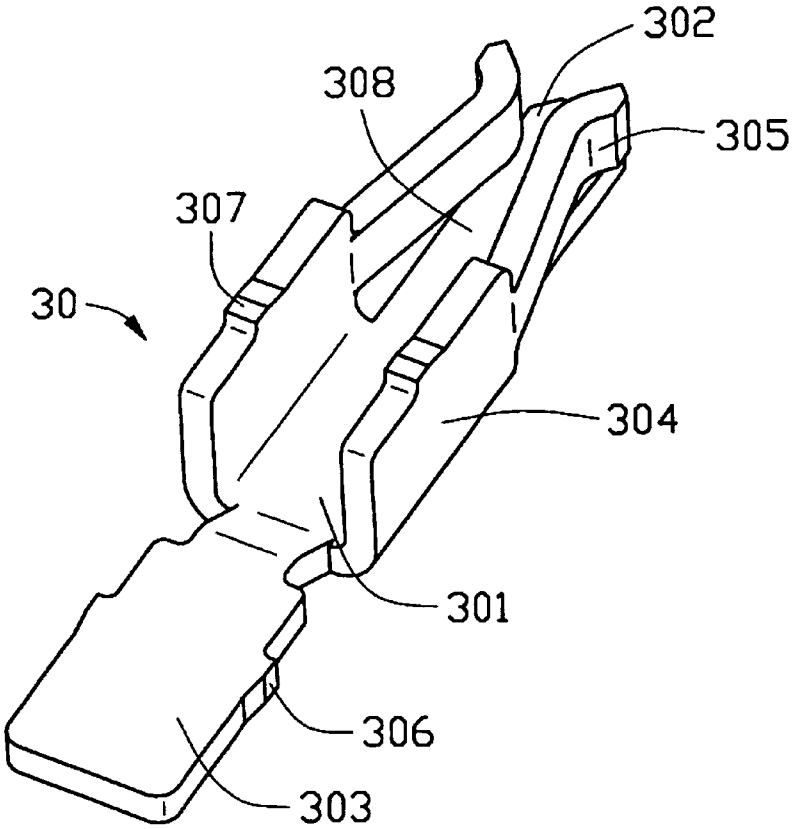
FIG. 4 is an enlarged perspective view of a terminal of the twinax coaxial flat cable connector assembly shown in FIG. 1.

Referring to FIG. 4, each terminal 30 comprises a bottom plate 301, a front portion 302 at a front end of the bottom plate 301, a rear portion 303 at a rear end of the bottom plate 301, a pair of side plates 304 extending upwardly from opposite sides of the bottom plate 301, and a pair of resilient portions 305 each extending from a corresponding side plate 304 to a front end of the terminal 30, The front portion 302 and the pair of resilient portions 305 together form a receiving portion 308 for receiving a mating contact of a complementary connector (not shown). The rear portion 303 forms a pair of opposite barbs 306 for interferingly engaging with the groove 205 of the insulative insert 20. An engaging barb 307 is formed at a top of each side plate 304.

An elongate grounding bar 309 is adapted to be received in the elongate slot 201 of the insulative insert 20.

Figure 5:
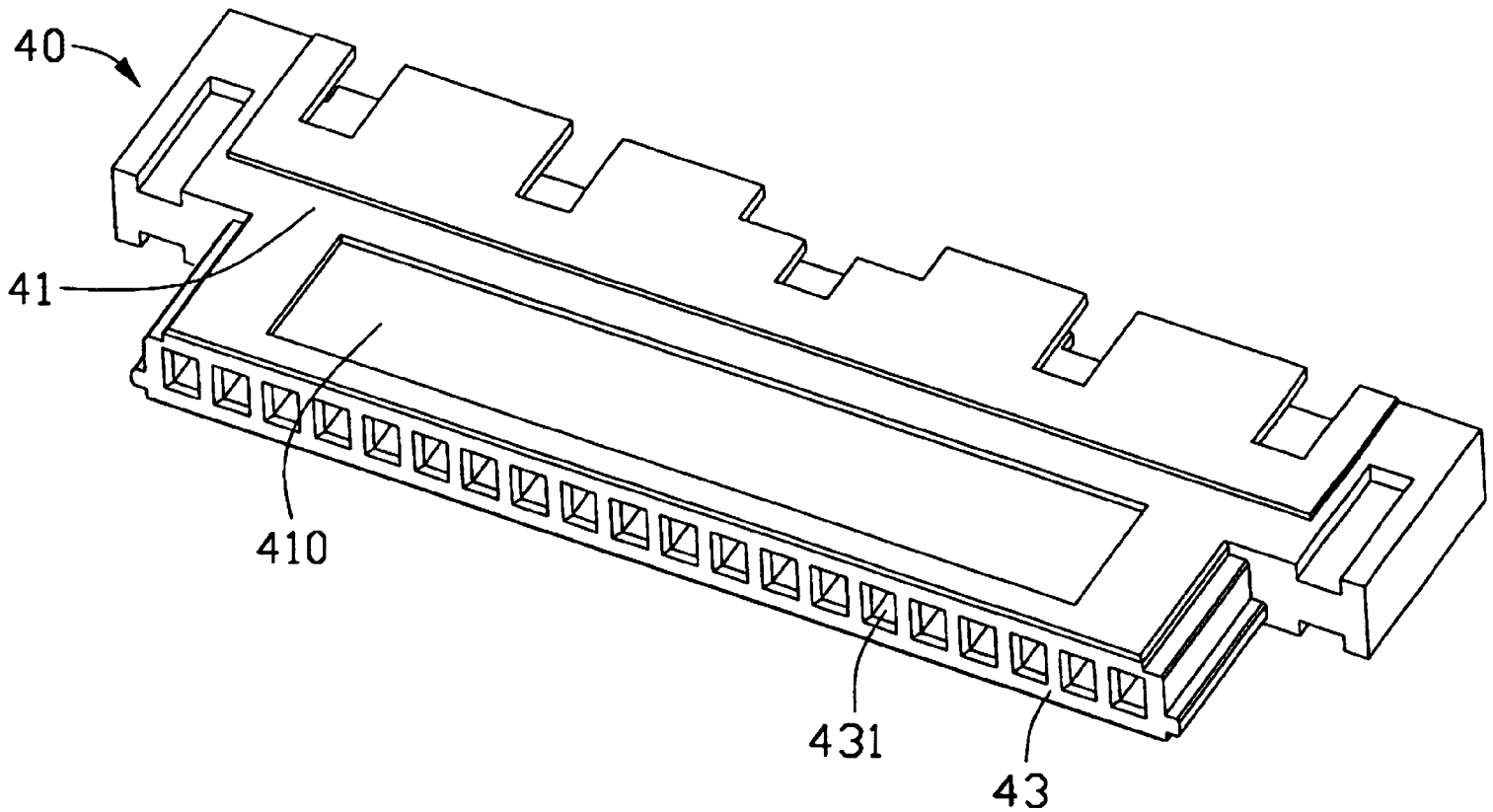
FIG. 5 is a perspective view of a housing of the twinax coaxial flat cable connector assembly viewed from a front aspect.

Referring to FIGS. 1 and 5, the housing 40 extends elongately and comprises an upper wall 41, a bottom wall 42, opposite side walls (not labeled), and a front wall 43. The upper wall 41, the bottom wall 42,the side walls and the front wall 43 together define a space 44 for receiving the insulative insert 20. The upper wall 41 defines a recess 410 at a front end thereof and a plurality of channels 412 at a rear end thereof. The front wall 43 defines a plurality of passageways 431 communicating with the space 44.

The shield 50 extends elongately and comprises an upper plate 51, a lower plate 52, and a pair of side plates (not labeled) connecting the upper plate 51 and the lower plate 52. A projecting plate 501 extends forwardly from the upper plate 51. A plurality of resilient tabs 502 extends inward from the upper plate 51 into a shield space 54 between the upper plate 51 and the bottom plate 52. The upper plate 51 forms a pair of first folding portions 504 extending into the shield space 54 and folding back upon themselves for catching the upper wall 41 of the housing 40. The bottom plate 52 also forms a series of second folding portions 522 projecting into the shield space 54 for catching the bottom wall 42 of the housing 40.

Figure 6:
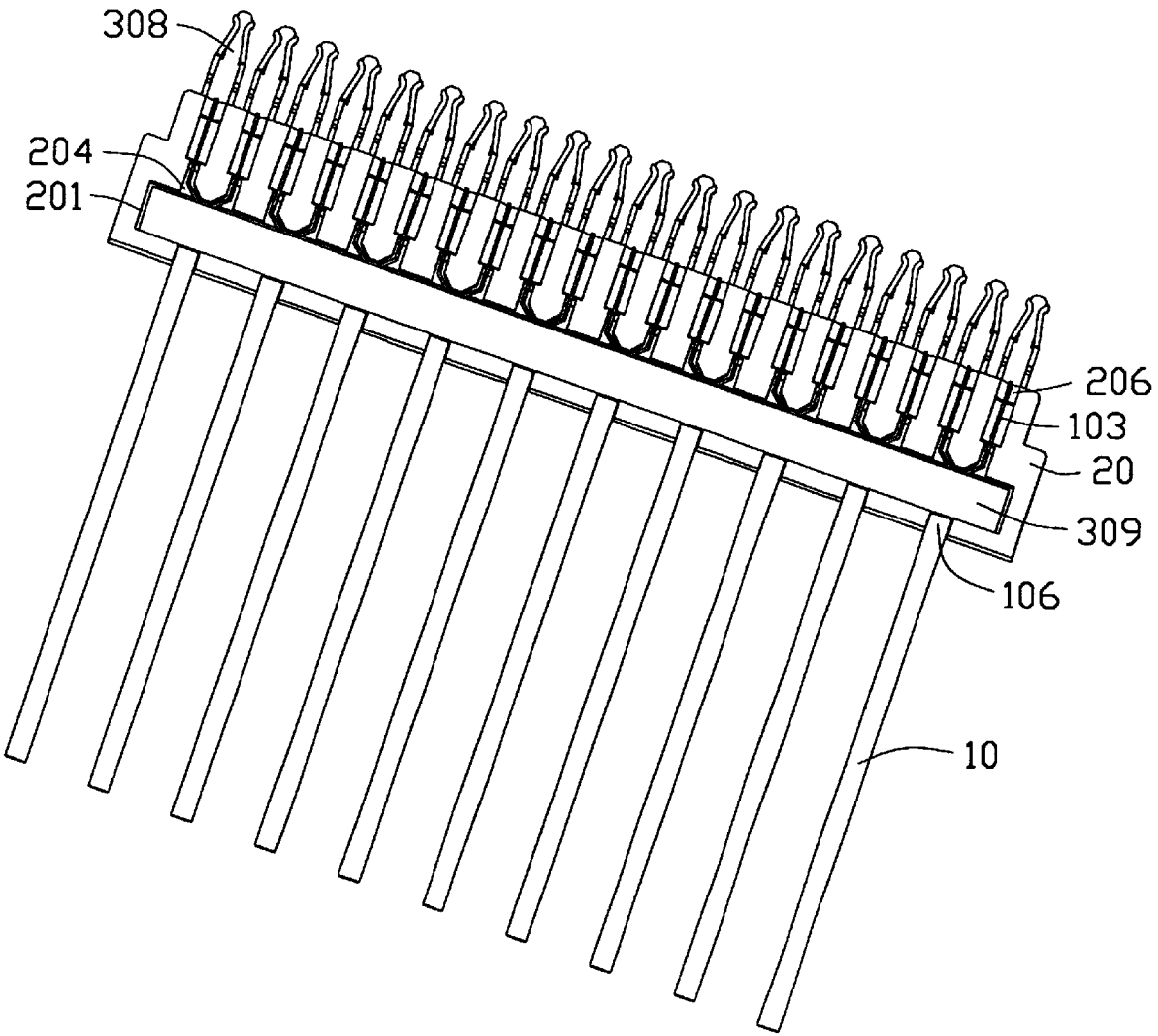
FIG. 6 is a partly assembled view of the twinax coaxial flat cable connector assembly without a housing and without an EMI shield.

Referring to FIG. 6, in assembly, the pair of barbs 306 of the rear portion 303 of the terminal 30 is first engaged with lateral sides (not shown) of the groove 205 of the insulative insert 20, thereby securing the rear portion 303 of the terminal 30 in the groove 205. Each twinax coaxial wire 10 is assembled in the insulative insert 20 with its cable jacket 106 being clamped in a corresponding channel 202 of the insulative insert 20, its metal braid 105 being received in the elongate slot 201 of the insulative insert 20, its two coaxial conductors 103 being received in corresponding slots 204 and contacting with the rear portions 303 of corresponding terminals 30. Each pair of projections 206 of the insert 20 positions the coaxial conductor 103 in the corresponding slot 204 and prevents the coaxial conductor 103 from escaping from the slot 204. The grounding bar 309 is assembled in the elongate slot 201 so that the grounding bar 309 and all the metal braids 105 of the twinax coaxial wires 10 are electrically connected together. The assembled insulative insert 20, terminals 30, twinax coaxial wires 10, and grounding bar 309 together form an insert subassembly 5 (see FIG. 6).

Figure 7:
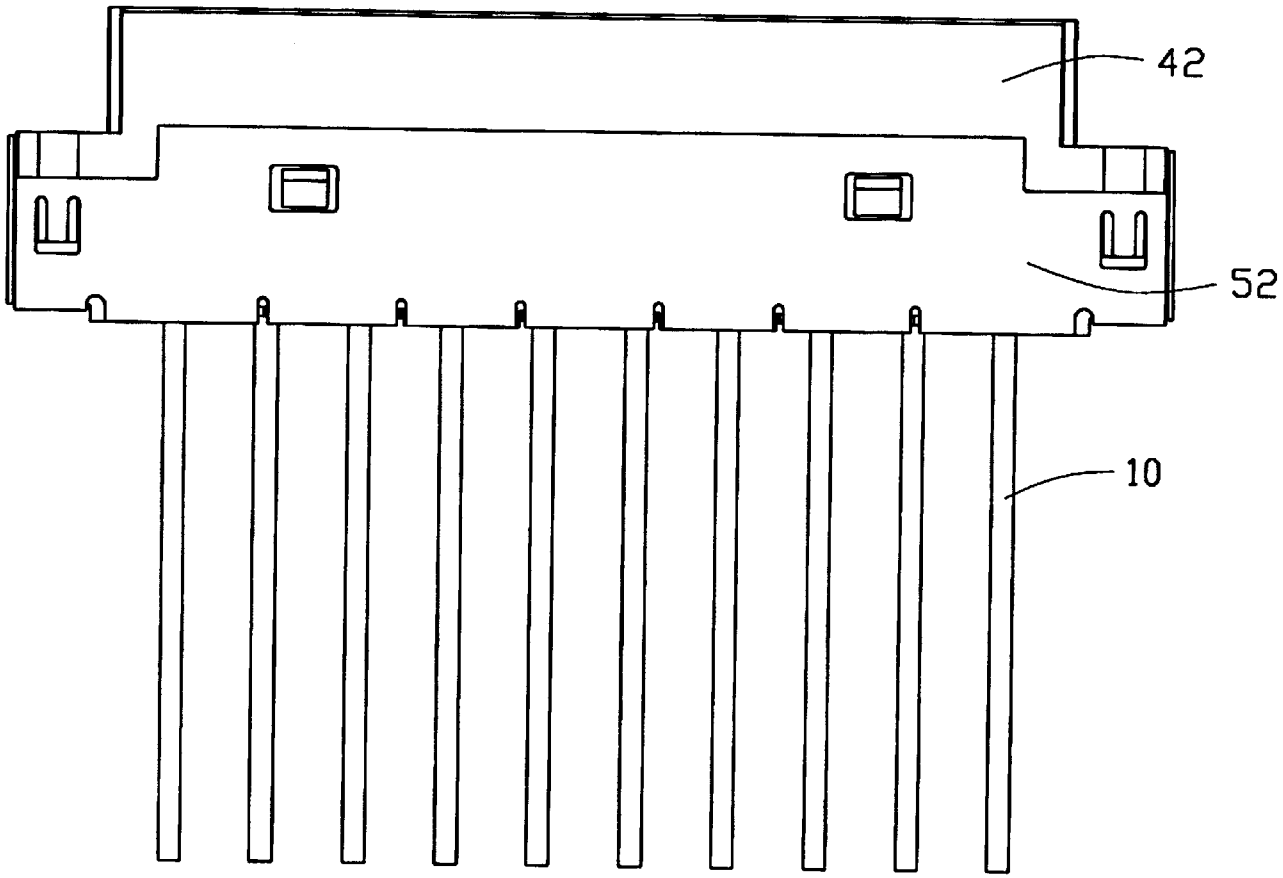
FIG. 7 is an assembled view of the twinax coaxial flat cable connector assembly viewed from a top aspect.
Figure 8:
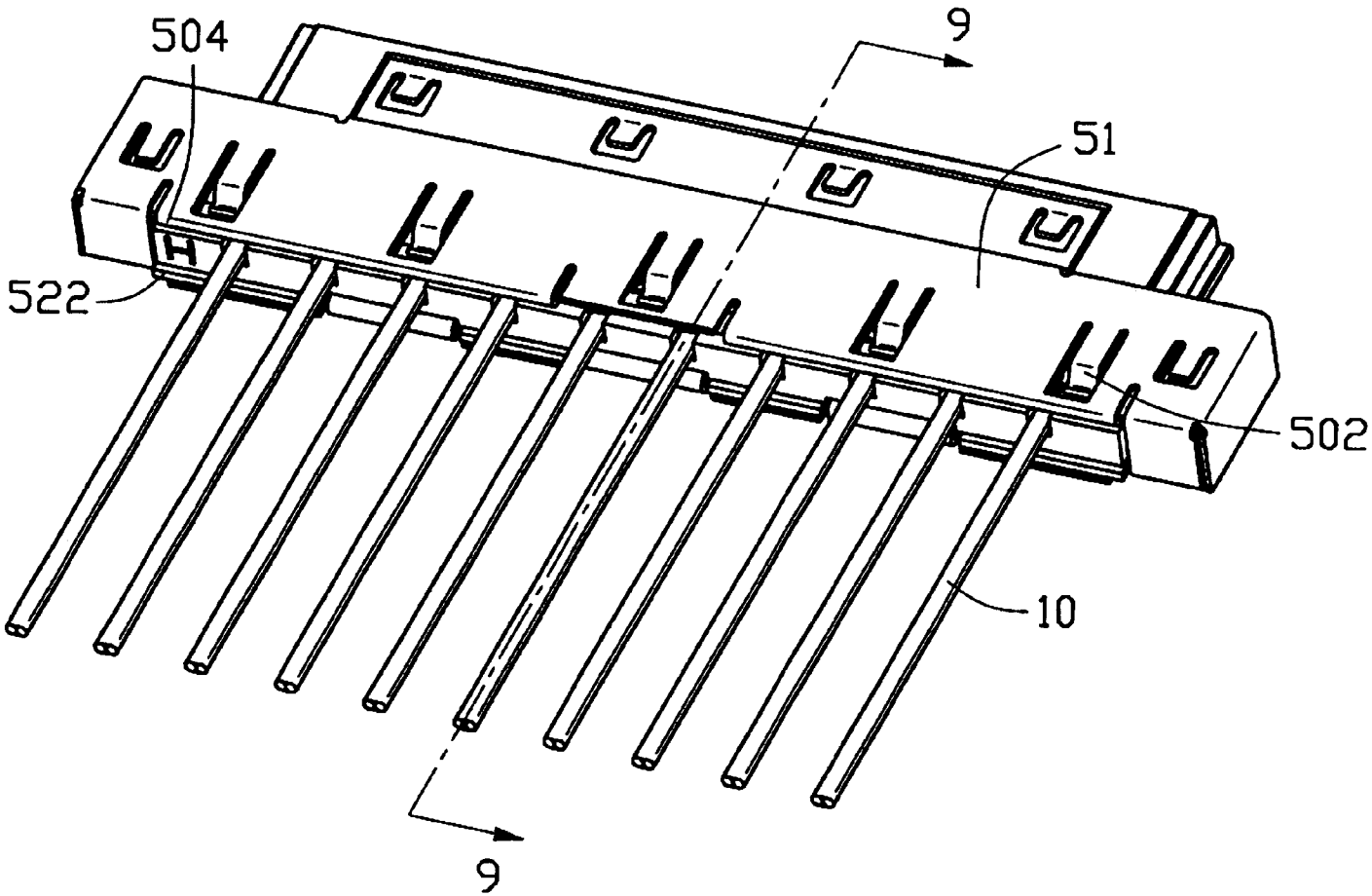
FIG. 8 is a perspective upside-down view of FIG. 7.
Figure 9:
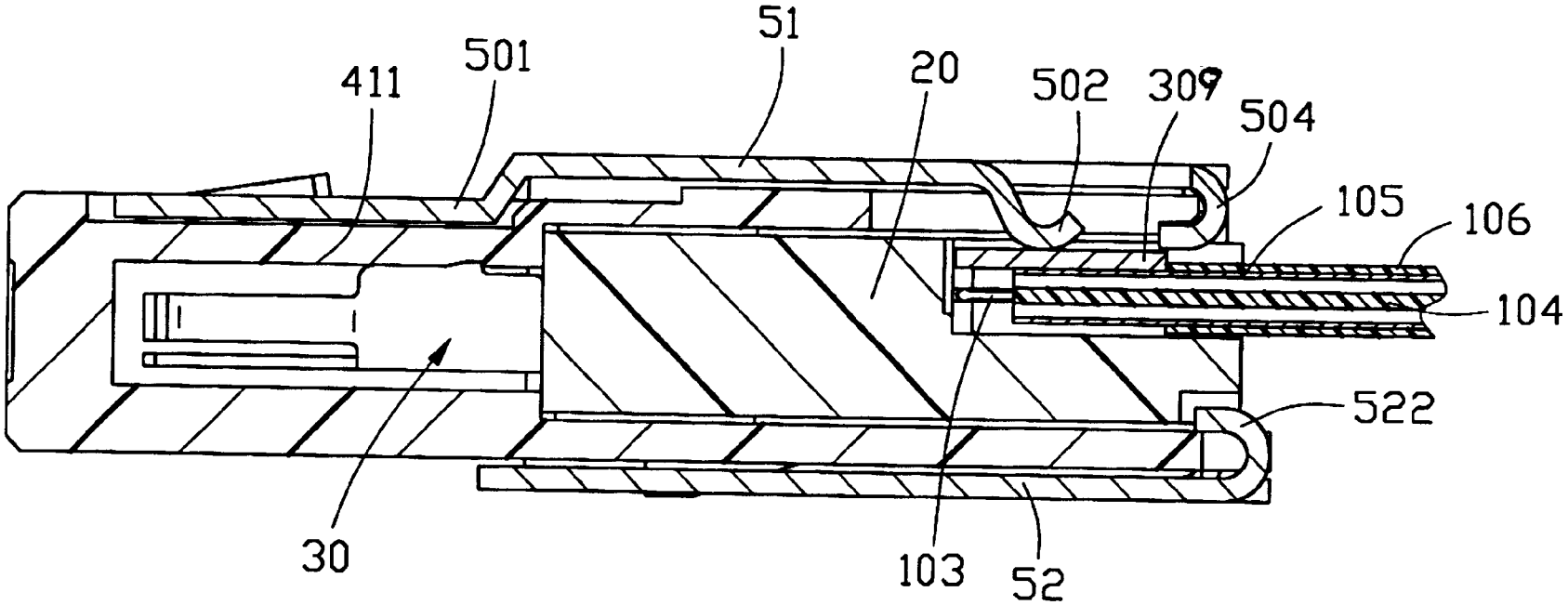
FIG. 9 is a cross sectional view of FIG. 8 taken from line 9—9.

Referring to FIGS. 7–9, the shield 50 is assembled to the housing 40 from a rear end of the housing 40, with the first folding portions 504 catching the rear end of the upper wall 41 of the housing 40 and the second folding portions 522 catching the rear end of the bottom wall 42 of the housing 40. The resilient tabs 502 extend through the channels 412 of the housing 40, and the projecting plate 501 is received in the recess 410. The insulative insert subassembly 5 is then inserted into the housing 40 with the engaging barbs 307 of the terminals 30 interferingly engaging with inner wall 411 of the upper wall 41 of the housing 40, thereby securely engaging the insert subassembly 5 within the housing 40. Each receiving portion 308 of the terminal 30 is received in each passageway 431 of the housing 40. Each resilient tab 502 of the shield 50 abuts against the grounding bar 309, and the shield 50, the resilient tabs 502, the grounding bar 309 and the metal braids 105 together form a grounding network for transmitting electrostatic charge from the twinax coaxial flat cable connector assembly 1 to a mating connector (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A twinax coaxial flat cable connector assembly comprising:

a plurality of twinax coaxial wires each having a pair of coaxial conductors isolated from each other and a layer of a metal braid surrounding the pair of coaxial conductors;

an insulative insert defining a plurality of grooves and a plurality of slots, each slot communicating with a corresponding groove and each slot for positioning a coaxial conductor of the twinax coaxial flat cable connector assembly in the insulative insert;

a plurality of terminals each of which comprises a rear portion received in a corresponding groove of the insulative insert and a receiving portion at a front end, the rear portion of the terminal contacting with a corresponding coaxial conductor of a corresponding twinax coaxial wire for transmitting high speed signals;

a housing defining a space for receiving the insulative insert, and defining a plurality of passageways communicating with said space, each receiving portion of each terminal being received in a corresponding passageway; and an EMI shield enclosing the housing.

2. The twinax coaxial flat cable connector assembly as claimed in claim 1, wherein the insulative insert further comprises a plurality of channels defined at a rear end thereof for securely receiving each twinax coaxial wire therein.

3. The twinax coaxial flat cable connector assembly as claimed in claim 1, wherein a pair of projections is formed on opposite sides of each slot, the projections being able to position the coaxial conductor in the slot and prevent the coaxial conductor from escaping from the slot.

4. The twinax coaxial flat cable connector assembly as claimed in claim 1, wherein the terminal comprises a bottom plate, the rear portion extends from the bottom plate, a pair of side plates extends upwardly from the bottom plate, each side plate forms an engaging barb for interferingly engaging with an inner wall of an upper wall of the housing, and the receiving portion of the terminal comprises a front portion extending from the bottom plate and a pair of resilient portions extending from both side plates.

5. The twinax coaxial flat cable connector assembly as claimed in claim 2, wherein an elongate slot is defined between the plurality of channels and the plurality of slots of the insulative insert, a bared portion of metal braid of each twinax coaxial wire is received in the elongate slot, the twinax coaxial flat cable connector assembly further comprises a grounding bar assembled on the bared portions of metal braid, a plurality of resilient tabs is formed on an upper plate of the shield which abut against the grounding bar for transmitting electrostatic charge on the twinax coaxial flat cable connector assembly.

6. The twinax coaxial flat cable connector assembly as claimed in claim 1, wherein an upper plate of the shield forms a first folding portion extending into a shield space of the shield for catching an upper wall of the housing and a bottom plate of the shield forms a second folding portion extending into the shield space for catching a lower wall of the housing.

7. A twinax coaxial flat cable connector assembly comprising:

a plurality of twinax coaxial wires each having a pair of coaxial conductors isolated from each other and a layer of a metal braid surrounding the pair of coaxial conductors;

an insulative insert defining a plurality of channels and a plurality of slots, each of said channels communicatively generally aligned with the two corresponding adjacent slots;

each wire being retainably received within the corresponding channel, the corresponding pair of coaxial conductors extending from said each wire separately and further received within the corresponding slots, respectively;

a plurality of terminals each comprising a rear portion disposed around the corresponding slot and mechanically and electrically connected to the corresponding conductor of a corresponding twinax coaxial wire for transmitting high speed signals;

a housing defining a space for receiving the insulative insert; and an EMI shield enclosing the housing.

8. The twinax coaxial flat cable connector assembly as claimed in claim 7, wherein a ground bar disposed on the insert and mechanically and electrically is connected between the shield and the braids of the wires.

* * * * *